US009975228B2

(12) United States Patent
Mascarenas

(10) Patent No.: US 9,975,228 B2
(45) Date of Patent: May 22, 2018

(54) AUTOMATED PIPE WRENCH ASSEMBLY

(71) Applicant: Joe Mascarenas, Ault, CO (US)

(72) Inventor: Joe Mascarenas, Ault, CO (US)

( * ) Notice: Subject to any disclaimer, the term of this patent is extended or adjusted under 35 U.S.C. 154(b) by 285 days.

(21) Appl. No.: 14/921,104

(22) Filed: Oct. 23, 2015

(65) Prior Publication Data

US 2017/0113333 A1 Apr. 27, 2017

(51) Int. Cl.
*B25B 13/50* (2006.01)
*B25B 28/00* (2006.01)

(52) U.S. Cl.
CPC ..... *B25B 28/00* (2013.01); *B25B 13/5075* (2013.01)

(58) Field of Classification Search
CPC ... B25B 28/00; B25B 23/147; B25B 23/0085; B25B 21/00; B25B 21/002
See application file for complete search history.

(56) References Cited

U.S. PATENT DOCUMENTS

| | | | | |
|---|---|---|---|---|
| 2,943,524 | A | 1/1959 | Bourne | |
| 3,709,072 | A * | 1/1973 | Rogers | B25B 13/5016 81/57.13 |
| 3,774,481 | A * | 11/1973 | Goodman | B25B 13/5016 81/57.13 |
| 4,178,817 | A * | 12/1979 | Gibson | B25B 13/5016 81/57.13 |
| D292,062 | S | 9/1987 | Doman et al. | |
| 6,336,381 | B2 * | 1/2002 | McDonnell | B25B 13/505 81/57.12 |
| 6,559,613 | B1 | 5/2003 | Elliot et al. | |
| 7,174,813 | B2 | 2/2007 | Davidson | |
| 7,246,541 | B1 * | 7/2007 | Divack | B25B 13/48 81/57.11 |
| 7,530,294 | B2 * | 5/2009 | Myburgh | B25B 21/002 81/57 |
| 7,637,186 | B1 | 12/2009 | Loscalzo | |
| 7,942,081 | B2 | 5/2011 | Hauk | |
| 8,141,459 | B2 * | 3/2012 | Myburgh | B25B 21/00 81/57 |

* cited by examiner

*Primary Examiner* — David B Thomas

(57) ABSTRACT

An automated pipe wrench assembly for tightening and loosening a pipe includes a wrench that may insertably receive a pipe. A drive is coupled to the wrench and the drive engages the pipe when the wrench insertably receives the pipe. The drive selectively rotates the pipe thereby facilitating the wrench to tighten the pipe.

13 Claims, 3 Drawing Sheets

AUTOMATED PIPE WRENCH ASSEMBLY

BACKGROUND OF THE DISCLOSURE

Field of the Disclosure

The disclosure relates to wrench devices and more particularly pertains to a new wrench device for tightening and loosening a pipe.

SUMMARY OF THE DISCLOSURE

An embodiment of the disclosure meets the needs presented above by generally comprising a wrench that may insertably receive a pipe. A drive is coupled to the wrench and the drive engages the pipe when the wrench insertably receives the pipe. The drive selectively rotates the pipe thereby facilitating the wrench to tighten the pipe.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
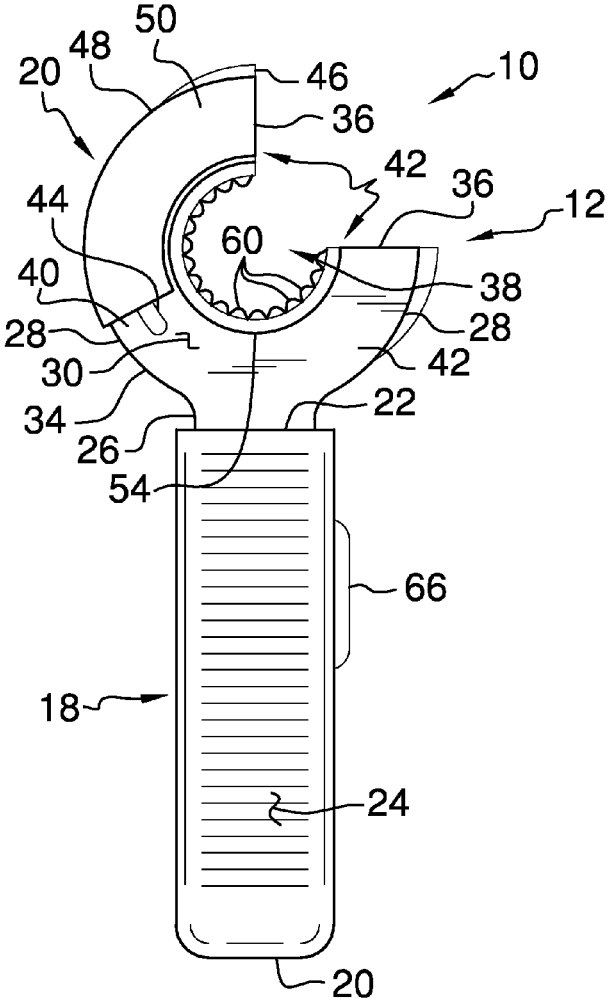
FIG. 1 is a right side view of an automated pipe wrench assembly according to an embodiment of the disclosure.
Figure 2:
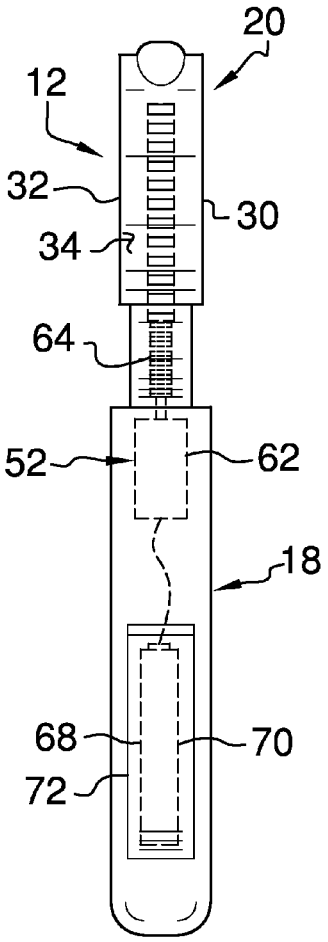
FIG. 2 is a back phantom view of an embodiment of the disclosure.
Figure 3:
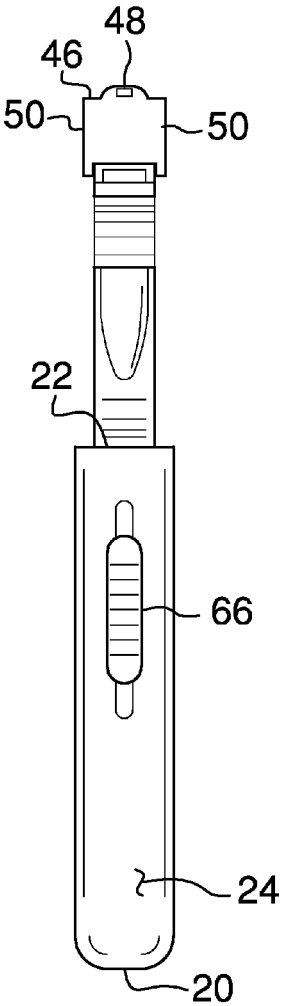
FIG. 3 is a front view of an embodiment of the disclosure.
Figure 4:
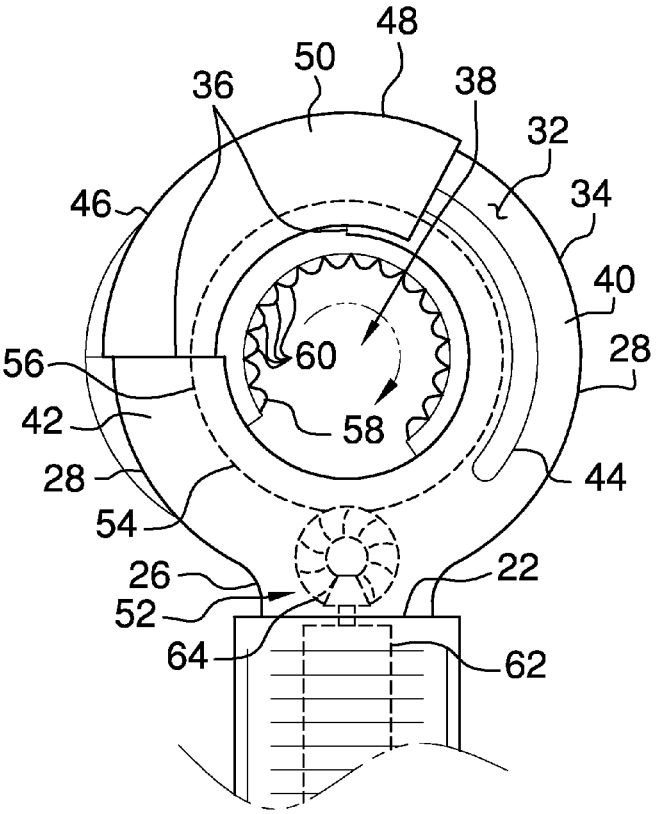
FIG. 4 is a right side phantom view of an embodiment of the disclosure.
Figure 5:
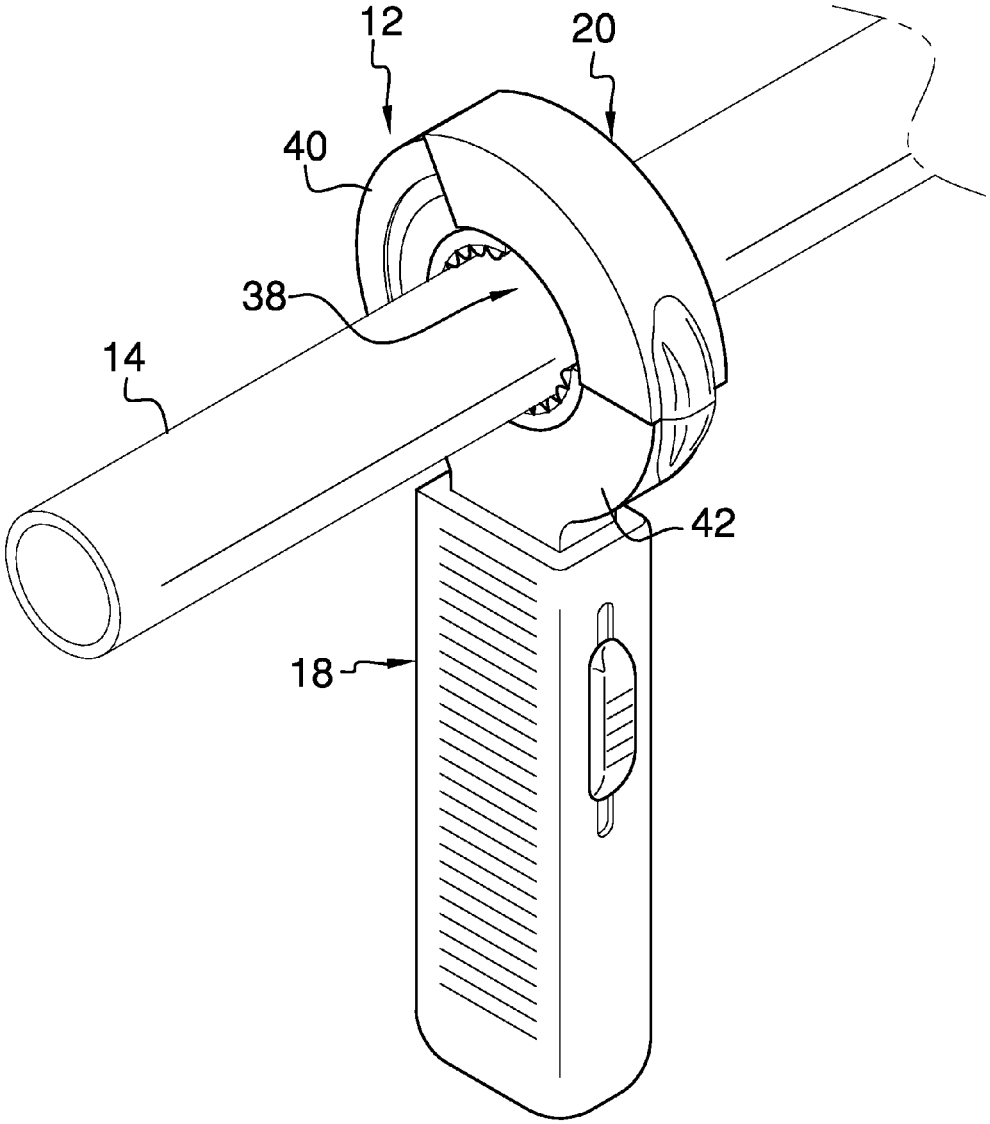
FIG. 5 is a perspective in-use view of an embodiment of the disclosure.

With reference now to the drawings, and in particular to FIGS. 1 through 5 thereof, a new wrench device embodying the principles and concepts of an embodiment of the disclosure and generally designated by the reference numeral 10 will be described.

As best illustrated in FIGS. 1 through 5, the automated pipe wrench assembly 10 generally comprises a wrench 12 that may insertably receive a pipe 14. The pipe 14 may comprise a rigid pipe utilized in the convention of gas plumbing or the like. The wrench 12 has a handle 16 and a head 18. The handle 16 has a first end 20, a second end 22 and an outer surface 24 extending between the first end 20 and the second end 22.

The head 18 comprises a stem 26 and a pair of arms 28. Each of the pair of arms 28 extends upwardly from the stem 26 and the stem 26 is coupled to and extends upwardly from the second end 22. Each of the arms 28 has a first lateral surface 30, a second lateral surface 32, an outwardly facing surface 34 and a distal end 36 with respect to the stem 26. Each of the arms 28 is curved between the distal end 36 and the stem 26 such that the distal end 36 of each of the arms 28 is directed toward each other.

Each of the arms 28 forms an opening 38 in the head 18 and the opening 38 has a bounding surface 39. The distal end 36 of each of the arms 28 is spaced from each other to define a space 41 between the arms 28. The space 41 may have the pipe 14 passed therethrough thereby facilitating the pipe 14 to extend through the opening 38. The pair of arms 28 includes a first arm 40 and a second arm 42. Each of the first lateral surface 30 and the second lateral surface 32 corresponding to the first arm 40 has a groove 44 extending inwardly therein. The groove 44 on each of the first lateral surface 30 and the second lateral surface 32 extends between the stem 26 and the distal end 36 corresponding to the first arm 40.

A cover 46 is provided that has a top wall 48 and a pair of lateral walls 50 each extending away from the top wall 48. The lateral walls 50 are spaced from each other. Each of the lateral walls 50 slidably engages the groove 44 on an associated one of the first lateral surface 30 and the second lateral surface 32. Thus, the cover 46 is slidably coupled to the head 18. The cover 46 is positionable in an open position such that the space 41 is exposed. The cover 46 is positionable in a closed position having the cover 46 extending across and closing the space 41. The top wall 48 releasably engages the outwardly facing surface 34 corresponding to the second arm 42 when the cover 46 is positioned in the closed position.

A drive 52 is coupled to the wrench 12 such that the drive 52 may engage the pipe 14 when the wrench 12 insertably receives the pipe 14. The drive 52 selectively rotates the pipe 14 thereby facilitating the wrench 12 to tighten the pipe 14. The drive 52 comprises a first gear 54 that has a first surface 56 and a second surface 58. The first gear 54 is slidably coupled to the bounding surface 39 of the opening 38 and the first gear 54 is coextensive with the bounding surface 39.

The first surface 56 comprises a plurality of raised bumps 60. The raised bumps 60 frictionally engage the pipe 14 when the pipe 14 is extended through the opening 38. The raised bumps 60 are spaced apart from each other and distributed along the first gear 54. Each of the raised bumps 60 may comprise a resiliently compressible material such as rubber or the like. The first gear 54 is positionable in a home position having the first gear 54 extending between the distal end 36 of each of the arms 28. Thus, the first gear 54 allows the pipe 14 to pass through the space 41.

A motor 62 is positioned within the handle 16 and the motor 62 is spaced from the first gear 54. The motor 62 is rotates in a first direction and a second direction. The motor 62 may comprise an electrical motor or the like. A second gear 64 is rotatably positioned within the stem 26 and the second gear 64 is rotatably coupled to the motor 62. The motor 62 rotates the second gear 64 when the motor 62 is turned on. The second gear 64 engages the second surface 58 of the first gear 54 such that the second gear 64 urges the first gear 54 to rotate around the opening 38. Thus, the drive 52 rotates the pipe 14.

A switch 66 is coupled to the outer surface 24 of the handle 16 such that the switch 66 may be manipulated between a forward position, a rearward position and an off position. The switch 66 is electrically coupled to the motor 62 such that the switch 66 turns the motor 62 on and off. The motor 62 rotates in the first direction when the switch 66 is positioned in the forward position thereby tightening the pipe 14. The motor 62 rotates in the second direction when the switch 66 is positioned in the rearward position thereby loosening the pipe 14. The motor 62 urges the first gear 54 into the home position when the motor 62 is turned off.

A power supply 68 is positioned within the handle 16. The power supply 68 is electrically coupled to the switch 66 and the power supply 68 comprises at least one battery 70. A battery cover 72 is removably coupled to the outer surface 24 of the handle 16. The battery 70 is positioned beneath the battery cover 72.

In use, the pipe 14 is passed through the space 41 such that the pipe 14 extends through the opening 38. The plurality of raised bumps 60 frictionally engages the pipe 14 and the cover 46 is manipulated into the closed position. The switch 66 is manipulated into a selected one of the forward position and the rearward position. The first gear 54 rotates within the opening 38 and the pipe 14 is rotated in a corresponding direction. The cover 46 is manipulated into the open position and the wrench 12 is removed from the pipe 14 after the pipe 14 has been manipulated.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. An automated pipe wrench assembly comprising:

a wrench being configured to insertably receive a pipe; and a drive being coupled to said wrench wherein said drive is configured to engage the pipe when said wrench insertably receives the pipe, said drive being configured to selectively rotate the pipe thereby facilitating said wrench to tighten the pipe; and wherein said wrench has a handle and a head, said handle having a first end, a second end and an outer surface extending between said first end and said second end, said head comprising a stem and a pair of arms.

2. The assembly according to claim 1, wherein each of said pair of arms extends upwardly from said stem, said stem being coupled to and extending upwardly from said second end, each of said arms having a first lateral surface, a second lateral surface, an outwardly facing surface and a distal end with respect to said stem, each of said arms being curved between said distal end and said stem such that said distal end of each of said arms is directed toward each other.

3. The assembly according to claim 2, wherein each of said arms forms an opening in said head, said opening having a bounding surface, said distal end of each of said arms being spaced from each other to define a space, said space being configured to have the pipe passed therethrough thereby facilitating the pipe to extend through said opening.

4. The assembly according to claim 2, wherein said pair of arms includes a first arm and a second arm, each of said first lateral surface and said second lateral surface having a groove extending inwardly therein, said groove on each of said first lateral surface and said second lateral surface extending between said stem and said distal end corresponding to said first arm.

5. The assembly according to claim 1, wherein:

said wrench has an opening, said opening having a bounding surface; and said drive comprises a first gear having a first surface and a second surface, said first gear being slidably coupled to said bounding surface of said opening, said first gear being coextensive with said bounding surface.

6. The assembly according to claim 5, wherein said first surface comprises a plurality of raised bumps wherein said raised bumps are configured to frictionally engage the pipe, said raised bumps being spaced apart from each other and distributed along said first gear.

7. The assembly according to claim 6, further comprising:

said wrench has a stem;

a motor being positioned within said handle, said motor being spaced from said first gear; and a second gear being rotatably positioned within said stem, said second gear being rotatably coupled to said motor, said motor rotating said second gear when said motor is turned on, said second gear engaging said second surface such that said second gear urges said first gear to rotate around said opening thereby facilitating said drive to rotate the pipe.

8. The assembly according to claim 7, further comprising:

said wrench having a handle, said handle having an outer surface;

said first gear being positionable in a home position; and a switch being coupled to said outer surface of said handle wherein said switch is configured to be manipulated, said switch being electrically coupled to said motor such that said switch turns said motor on and off, said motor urging said first gear into said home position when said motor is turned off.

9. The assembly according to claim 8, further comprising a power supply being positioned within said handle, said power supply being electrically coupled to said switch, said power supply comprising at least one battery.

10. The assembly according to claim 5, wherein:

said wrench has a pair of arms, each of said arms having a distal end, each of said arms forming a space; and said first gear is positionable in a home position having said first gear extending between said distal end of each of said arms wherein said first gear is configured to allow the pipe to pass through said space.

11. An automated pipe wrench assembly comprising:

a wrench being configured to insertably receive a pipe; and a drive being coupled to said wrench wherein said drive is configured to engage the pipe when said wrench insertably receives the pipe, said drive being configured to selectively rotate the pipe thereby facilitating said wrench to tighten the pipe;

said wrench having head, said head having a first lateral surface and a second lateral surface, each of said first lateral surface and said second lateral surface having a groove extending inwardly therein; and a cover having a top wall and a pair of lateral walls extending away from said top wall, said lateral walls being spaced from each other, each of said lateral walls slidably engaging said groove on an associated one of said first lateral surface and said second lateral surface such that said cover is slidably coupled to said head.

12. The assembly according to claim 11, wherein:

said head has a space; and said cover is positionable in an open position such that said space is exposed, said cover being positionable in a closed position having said cover extending across and closing said space, said top wall releasably engaging said outwardly facing surface when said cover is positioned in said closed position.

13. An automated pipe wrench assembly comprising:

a wrench being configured to insertably receive a pipe, said wrench having a handle and a head, said handle having a first end, a second end and an outer surface extending between said first end and said second end, said head comprising a stem and a pair of arms, each of said pair of arms extending upwardly from said stem, said stem being coupled to and extending upwardly from said second end, each of said arms having a first lateral surface, a second lateral surface, an outwardly facing surface and a distal end with respect to said stem, each of said arms being curved between said distal end and said stem such that said distal end of each of said arms is directed toward each other, each of said arms forming an opening in said head, said opening having a bounding surface, said distal end of each of said arms being spaced from each other to define a space, said space being configured to have the pipe passed therethrough thereby facilitating the pipe to extend through said opening, said pair of arms including a first arm and a second arm, each of said first lateral surface and said second lateral surface having a groove extending inwardly therein, said groove on each of said first lateral surface and said second lateral surface extending between said stem and said distal end corresponding to said first arm;

a cover having a top wall and a pair of lateral walls extending away from said top wall, said lateral walls being spaced from each other, each of said lateral walls slidably engaging said groove on an associated one of said first lateral surface and said second lateral surface such that said cover is slidably coupled to said head, said cover being positionable in an open position such that said space is exposed, said cover being positionable in a closed position having said cover extending across and closing said space, said top wall releasably engaging said outwardly facing surface corresponding to said second arm when said cover is positioned in said closed position; and a drive being coupled to said wrench wherein said drive is configured to engage the pipe when said wrench insertably receives the pipe, said drive being configured to selectively rotate the pipe thereby facilitating said wrench to tighten the pipe, said drive comprising:

a first gear having a first surface and a second surface, said first gear being slidably coupled to said bounding surface of said opening, said first gear being coextensive with said bounding surface, said first surface comprising a plurality of raised bumps wherein said raised bumps are configured to frictionally engage the pipe, said raised bumps being spaced apart from each other and distributed along said first gear, said first gear being positionable in a home position having said first gear extending between said distal end of each of said arms wherein said first gear is configured to allow the pipe to pass through said space, a motor being positioned within said handle, said motor being spaced from said first gear, a second gear being rotatably positioned within said stem, said second gear being rotatably coupled to said motor, said motor rotating said second gear when said motor is turned on, said second gear engaging said second surface such that said second gear urges said first gear to rotate around said opening thereby facilitating said drive to rotate the pipe, a switch being coupled to said outer surface of said handle wherein said switch is configured to be manipulated, said switch being electrically coupled to said motor such that said switch turns said motor on and off, said motor urging said first gear into said home position when said motor is turned off, and a power supply being positioned within said handle, said power supply being electrically coupled to said switch, said power supply comprising at least one battery.

* * * * *